United States Patent [19]

Löf

[11] 4,135,257

[45] Jan. 23, 1979

[54] FLOATING POOL COVER

[76] Inventor: Lance G. A. Löf, 1615 17th St., Denver, Colo. 80202

[21] Appl. No.: 814,498

[22] Filed: Jul. 11, 1977

[51] Int. Cl.[2] ..... E04H 3/19

[52] U.S. Cl. ..... 4/172.12

[58] Field of Search ..... 4/172, 172.11, 172.12, 4/172.13, 172.14, 172.19; 114/266, 270; 9/11 R; 220/226, 221

[56] References Cited

U.S. PATENT DOCUMENTS

| | | | |
|---|---|---|---|
| 2,870,455 | 1/1959 | Reeves | 4/172.12 |
| 3,600,721 | 8/1971 | Pusey | 4/172.12 |
| 3,732,581 | 5/1973 | Pitti et al. | 4/172.12 X |
| 3,940,809 | 3/1976 | Hughes | 4/172.12 |
| 3,984,882 | 10/1976 | Forman et al. | 4/172.12 X |
| 4,000,532 | 1/1977 | Nielsen | 114/270 X |

FOREIGN PATENT DOCUMENTS

| | | | |
|---|---|---|---|
| 660246 | 6/1965 | Belgium | 4/172.12 |

*Primary Examiner*—Stuart S. Levy
*Attorney, Agent, or Firm*—Richard D. Law

[57] ABSTRACT

A sheet or film of cover material having a flotation member around the peripheral edge, with the cover material being cut to the size and shape of the surface of the pool to completely cover the water of a swimming pool. In one form, a flotation member is a foamed plastic cylinder encased in a waterproof sheath which is attached to a pocket formed in the sheet periphery.

1 Claim, 7 Drawing Figures

FLOATING POOL COVER

Covers of various types have been used for swimming pools for many years. Such covers have a recognized value in keeping a pool free from debris. By using a transparent plastic film, an effective heat source may be obtained from solar radiation passing through the cover into the water. Further, the cover is water impervious and prevents evaporation and prevents the resultant heat loss due to the evaporation of the water.

Some prior art plastic pool covers generally have been prepared from two superimposed plastic films with heat seal lines, of the waffle type, forming a plurality of air pods between the two films. This floating assembly may be cut to pool size so that it floats on the surface of the water. The edges, however, are limp and the cover is easily wrinkled and folded thereby uncovering some of the pool's surface.

According to the present invention there is provided a clear, transparent, essentially waterproof plastic cover for a swimming pool. A flotation member is provided at least around the peripheral edge of the swimming pool cover to provide sufficient strength and semi-rigidity of the edge to maintain the cover in water covering position, preventing the edges from curling and folding and thus exposing a portion of the pool. The flotation member is a porous, foamed plastic cylinder of light density, encased in a waterproof sheath, and the sheath is then secured in a pocket or hem in the periphery of the cover. In some cases, it may be desirable to supply additional flotation and rigidity for the cover, which is easily accomplished by securing a length of the sheathed foam plastic to various portions of the cover inward of the edge.

Included among the objects and advantages of the invention is to provide a single thickness, clear, transparent plastic film as a swimming pool cover.

Another object of the invention is to provide a transparent swimming pool cover arranged to the shape of the pool and provided with a peripheral edge structure having a flotation capability to maintain the cover in floating position and completely covering the surface of the water.

Still another object of the invention is to provide a swimming pool cover with a peripheral edge floating assembly.

Yet another object of the invention is to provide a swimming pool cover with peripheral edge assembly providing sufficient rigidity to maintain the cover completely spread out over the surface of the water.

An additional object of the invention is to provide an inexpensive pool cover which is an effective solar heat transfer means and provide a cover to prevent debris from entering the water.

A further object of the invention is to provide an inexpensive, highly effective flotation means for a swimming pool cover arranged to be easily secured to a plastic film and which is arranged to maintain its flotation capability.

These and other objects and advantages of the invention may be readily acertained by referring to the following description and appended illustrations in which.

Figure 1:
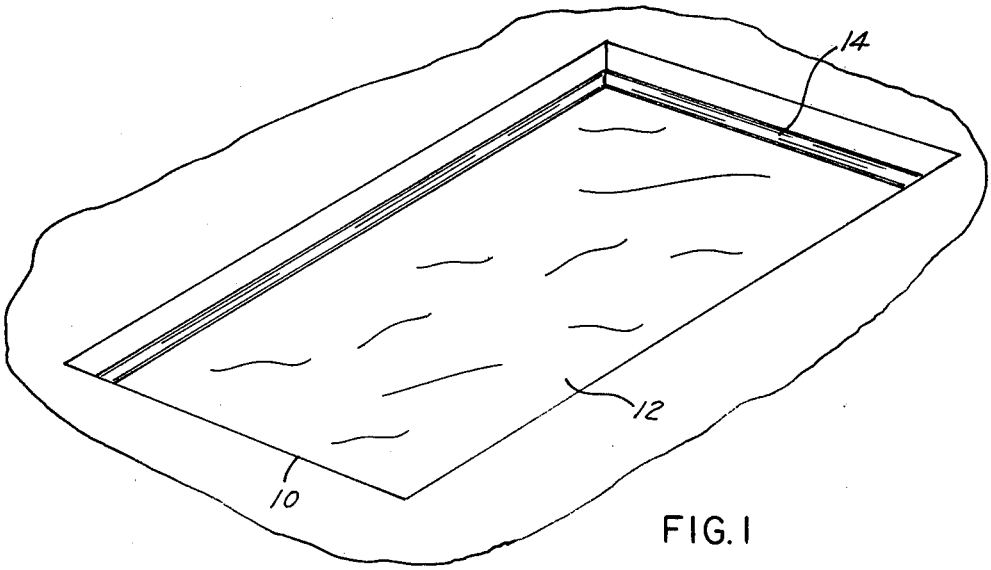
FIG. 1 is a perspective view of a swimming pool with a pool cover, according to the invention, in place on the surface of the water.

In the device of FIG. 1, a rectangular shaped swimming pool, of the in-ground type, is illustrated with a swimming pool cover, made according to the invention, in place on the surface of the water. The pool 10 is illustrated as a rectangular pool, and the cover 12, obviously, is rectangular of a size and shape to cover the surface of the water in the pool. Edge flotation means 14 are arranged around the periphery of the plastic film 12 providing flotation for the cover as well as semi-rigidity for holding the cover in complete cover position over the surface of the water. The plastic film may be of any conventional and available flexible film, such as acrylic, nylon, polycarbonate, polyvinyl chloride, polyethylene, and similar films which may be from 2 to 20 or more mils. The plastic, preferably, is clear and transparent to permit solar rays to pass through the cover into the water, thereby providing heat for the water. Preferably, the cover is water impervious or waterproof so as to prevent evaporation of the pool water. This prevents a loss of water as well as a loss of heat due to the evaporation.

Figure 2:
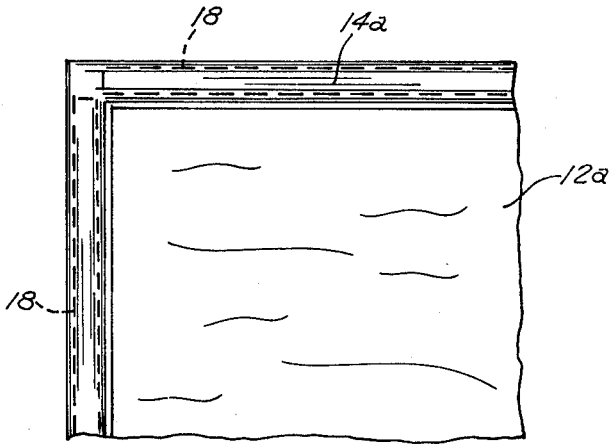
FIG. 2 is an enlarged detail of a small section of a rectangular pool cover according to the invention.
Figure 3:
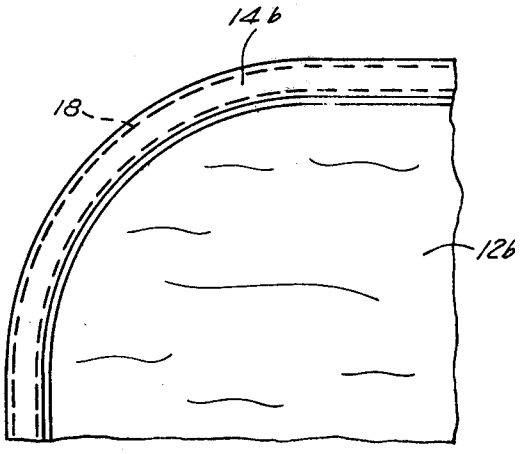
FIG. 3 is an enlarged detail of a small section of a curved pool cover.

The plastic film may be readily cut to the exact size of the surface of the water of the pool, and the flotation means attached to the edge so that the cover will completely enclose the water of the pool. As shown in FIG. 2 a plastic film **12*a* of rectangular shape is provided with flotation means 14*a* secured to the periphery of the plastic sheet. For this configuration, a square corner is formed. A circular pool cover 12*b* is shown in FIG. 3, which has the flotation means 14*b*** secured to the circular edge. The configuration of the film may be any shape necessary for the pool. Preferably the covering should be a one-piece sheet covering the pool, and in some instances it may be necessary to provide a seam between the several sheets to provide sufficient width or length for covering the pool.

Figure 4:
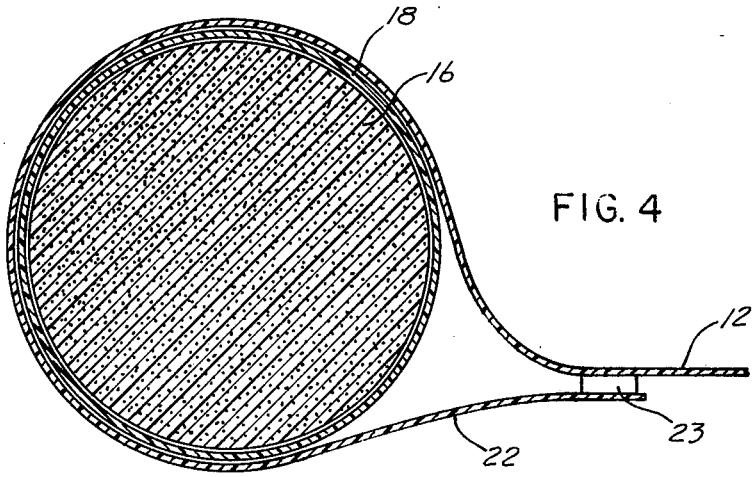
FIG. 4 is an enlarged detail of a flotation member secured in a pocket in an edge of a plastic film.
Figure 5:
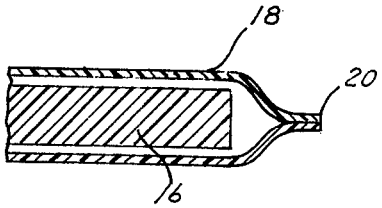
FIG. 5 is an enlarged side elevational view of the sealed end of a flotation member according to the invention.

The flotation means, shown in FIG. 5, includes a cylinder 16 of a foamed lightweight plastic. This is preferably a flexible foam. Many flexible foams are usually open-cell foams or at least partially open cells and may include such compositions as polyethylene foams, polystyrene foams, flexible vinyl foams, flexible urethane foams, etc. The foams are used as flotation material and therefore should be as light as practical, usually in the range of 1½ or 2 pounds per cubic foot to about 10–15 pounds per cubic foot. Opencell foams generally absorb substantial quantities of water and lose their flotation capability. To prevent the loss of such capability and to maintain the foam waterproof, it is placed in a sheath or sleeve of water-impervious material 18, which may be a tube of polyethylene, or like film material sealed at the end 20. The shape of the foam material is conveniently cylindrical and, therefore, the sheet 18 is conveniently tubular so that both ends may be closed and sealed to provide an air and water tight flotation member. As shown in FIG. 4, the flotation member may be placed in the edge of a sheet, by folding its edge 22 back on itself and sealing the flotation member in the pocket formed by the turned back edge of the material. The seal 23 may conveniently be made as a heat seal, however, solvent sealing is, also, practical.

The cylindrical foam flotation material is preferably flexible so that the cover may be readily rolled or folded as desired, and it, also, provides for easy handling of the unit and placing it on and removing it from the water. Further, by being flexible it may be made to fit the edge of curved edges of a pool cover and conform with the shape of the pool regardless of its configuration. The turned back edge of the plastic need not be a watertight seal, since the flotation means is watertight. Further, the foam cylinder should be a size, for example, one to two inches in diameter, which provides sufficient rigidity and springiness to hold the pool cover completely over the surface of the water and generally against the edge of the swimming pool. The foam cylinders generally are provided in long lengths which may be rolled up on a reel. However, when laid out it generally tends to assume a rather straight configuration. This provides means for holding the cover against the sides of the pool completely covering the water regardless of the shape of the cover.

Figure 6:
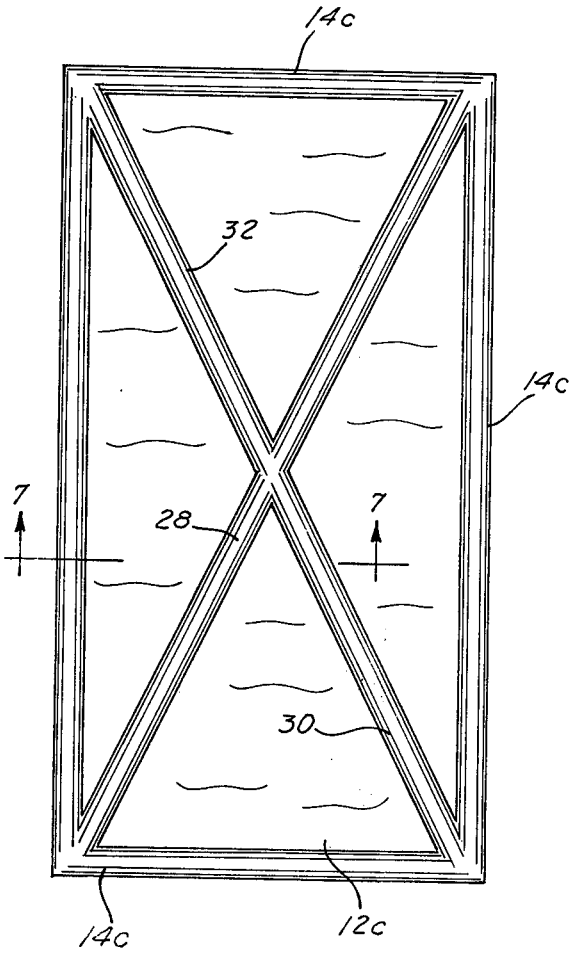
FIG. 6 is a top plan view of a modified form of the pool cover of the invention.
Figure 7:
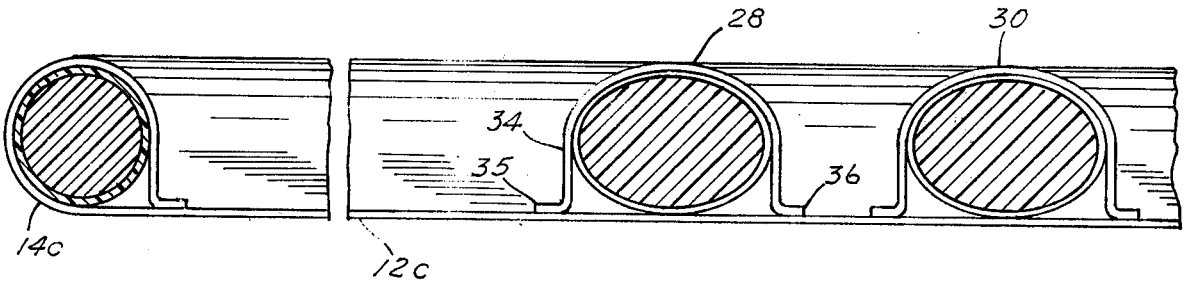
FIG. 7 is a cross-sectional view of the device of FIG. 6 taking along section line 7—7.

In some instances it may be desired to provide more flotation to a cover than only the peripheral edges. In such cases, the waterproof, sheathed foam lengths may be secured in strips to any part of the cover surface. For example, in FIG. 6 a pool cover 12*c* of generally rectangular configuration is provided with flotation means 14*c* around its periphery in cover for a pool. For most installations, one person may readily place the cover on the pool, with the foam material providing means for springing the cover into its water covering position on the pool. The flotation provides sufficient springiness so that anchoring the cover to the pool edges is not necessary to provide a complete cover on the surface of the water. The foamed plastic, which is encased in a waterproof sheath, maintains its flotation capabilities as well as its springiness to maintain the shape of the cover on the surface of the pool. This ability to maintain the cover on the pool occurs even under conditions of substantial rain or snow, and under the weight of debries such as leaves, dirt, and the like which may fall into the pool, thereby keeping the pool clean, maintaining heating capabilities and preventing evaporation.

The foamed flotation material may be an extended rod which has a skin, or it may be rod cut from a block of foam. Usually the cut foam requires the vinyl tubing for water proofing the foam for long service. A vinyl tube, filled with air may be placed in the pockets to maintain the cover flotation for extended periods of time. The filled pockets with foam or the air filled tube provides the flotation as well as the springiness to keep the cover over the surface of the pool.

What is claimed is:

1. A floating swimming pool cover comprising:

a. a sheet of generally water impervious, flexible, transparent, plastic shaped to the size and configuration of the surface of the water in the pool;

b. flotation means secured to the peripheral edge of said sheet, generally completely therearound, and said flotation means comprising a long length of light weight, floatable, foamed, open cell plastic cylinder, and a waterproof plastic sheath encasing and sealed around said cylinder providing a waterproof flotation member; said flotation member having sufficient strength and semi-rigidity and springiness to maintain the sheet over the surface of the water and against the edge of the swimming pool; and, c. means at the edge of said sheet, including pocket means formed by folding back the peripheral edge portion of the sheet and securing the edge to the sheet to form a pocket, securing said flotation means in said pocket at the peripheral edge of said sheet.

* * * * *